US006444056B1

(12) United States Patent
Nakamura et al.

(10) Patent No.: US 6,444,056 B1
(45) Date of Patent: Sep. 3, 2002

(54) REFINED MAGNESIUM MATERIAL AND METHOD FOR PRODUCING THE SAME

(75) Inventors: Tadayoshi Nakamura, Ibaraki; Kazumi Tanaka, Kitakyushu, both of (JP)

(73) Assignee: Nippon Kinzoku Co., Ltd., Tokyo (JP)

( * ) Notice: Subject to any disclaimer, the term of this patent is extended or adjusted under 35 U.S.C. 154(b) by 0 days.

(21) Appl. No.: 08/710,685

(22) Filed: Sep. 23, 1996

Related U.S. Application Data

(62) Division of application No. 08/240,726, filed as application No. PCT/JP93/01291 on Sep. 10, 1993, now Pat. No. 5,613,999.

(30) Foreign Application Priority Data

Sep. 11, 1992 (JP) ..... 4-269365

(51) Int. Cl.[7] ..... C22C 23/00
(52) U.S. Cl. ..... 148/420; 420/411
(58) Field of Search ..... 420/402, 411, 420/413; 148/420

(56) References Cited

U.S. PATENT DOCUMENTS

| | | | | |
|---|---|---|---|---|
| 1,914,588 A | 6/1933 | Wood | | 420/411 |
| 4,605,438 A | 8/1986 | Keith et al. | | 75/603 |
| 5,223,215 A | 6/1993 | Charbonnier et al. | | 148/420 |

FOREIGN PATENT DOCUMENTS

| | | | |
|---|---|---|---|
| CA | 683938 | 4/1964 | 75/602 |
| EP | 90-02209 | 3/1990 | |
| JP | 45-13202 | 5/1970 | |
| JP | 45-25569 | 8/1970 | |
| JP | 46-34290 | 10/1971 | |
| JP | 2-47238 | 2/1990 | |
| JP | 3-10041 | 1/1991 | |
| JP | 3-47941 | 2/1991 | |
| JP | 3-501870 | 4/1991 | |
| JP | 5-5135 | 1/1993 | |
| WO | 93/152238 | * 8/1993 | |

* cited by examiner

*Primary Examiner*—Melvyn Andrews
(74) *Attorney, Agent, or Firm*—Merchant & Gould P.C.

(57) ABSTRACT

A process for producing a refined magnesium material which is flame retardant by adding an alkaline earth metal. In the process, the dross in a thin film is formed on the surface of the molten magnesium material by contacting it with a dross-formable atmosphere gas while the molten magnesium material is subjected to a vertical vortex flow. The dross encloses the impurity floating on the surface of molten magnesium material through the vortex flow in a vertical direction. The resultant dross is accumulated at the corner of the crucible to prevent the re-diffusion of the impurity. The continuous application of the vortex flow against the molten magnesium material causes the thin film of dross to be continuously formed on the molten magnesium material and adhered thereto so as to enclose the impurity each time it is formed. Accordingly, the molten magnesium material is improved in cleanliness or refined. Solidifying the molten magnesium material by cooling serves to provide an ingot for casting which is extremely reduced in the porosity peculiar to the addition of an alkaline earth metal. Casting such the ingot serves to provide a product having good qualities.

7 Claims, 1 Drawing Sheet

REFINED MAGNESIUM MATERIAL AND METHOD FOR PRODUCING THE SAME

This is a Divisional of application Ser. No. 08/240,726, filed Jul. 11, 1994, now U.S. Pat. No. 5,613,999, which application(s) are incorporated herein by reference, which is a 317 of PCT/JP93/01291 filed Sep. 10, 1993.

BACKGROUND OF THE INVENTION

1. Field of the Invention

The present invention relates to a refined magnesium material such as an ingot or billet used for parts of transport and home electric apparatus as well as kinds of cases and a process for producing the refined magnesium material.

2. Description of the Prior Art

Aluminum alloy is widely used for a case such as an oil pan and a transmission case in a vehicle. Much attention has been paid to a magnesium alloy, because the parts can be made lighter from the magnesium alloy than an aluminum alloy. Further, a magnesium composite material having reinforcing agents added therein has been investigated. The present invention relates to magnesium, various magnesium alloy and magnesium composite, all of which hereinafter are referred to as "magnesium material".

In general, the magnesium material in a molten state is highly flammable when it comes to be in contact with air and thereby, the molten magnesium material is more difficult to handle than the molten aluminum material.

(1) The die casting or the squeeze casting of magnesium material must be carried out under a condition wherein the molten magnesium material to be cast is separated from air by inflammable gas $SF_6$ or a mixture of $SF_6$ and $CO_2$. On the other hand, the gravity casting must be carried out under a condition wherein the molten material to be cast is overspread by a flame resistant flux mainly containing sulfur. However, there are the following problems. The overspread gas, $SF_6$ is expensive and results in a high manufacturing cost. The gravity casting generates $SO_2$ gas due to the sulfur powder and results in a poor working environment.

(2) In a case of refining a returned magnesium material or scrap, there are the following problems. In order to prevent the molten magnesium material from catching fire, the refining process must be carried out by using a flux agent, which makes the manufacturing cost expensive and causes the resultant magnesium material to be inferior in corrosion resistance.

(3) The casting process of the magnesium material is not carried out in the way exactly the same as that of aluminum costing process in view of the facility and the working steps. When a die casting of a hot chamber type is applied to the magnesium material, a specified die casting machine is required. When the die casting of a cold chamber type is applied thereto, watching for the prevention of fire is required. This prevents the automatic casting of magnesium material. Further, it is difficult to apply a lost wax process to the casting of magnesium material.

These disadvantageous points result from the intrinsic property of magnesium material such as an easy flammability of the molten magnesium material, resulting in difficulty in ensuring safe operation and high-cost.

In order to solve the problem, one of inventors, Tadayoshi Nakamura has proposed a method for providing the molten magnesium material with a flame-resistant property by adding an alkaline earth metal or metals such as calcium to the molten magnesium material and further a method for recovering the original corrosion resistance of the magnesium material, which is degraded due to addition of alkaline earth metal, by adding a corrosion resistant metal such as zinc (Japanese Patent Application No. 54394/1992).

However, even if the magnesium material is provided with alkaline earth metal, it does not show sufficiently the flame resistant property, resulting in generation of some ignition point. Although the ignition point may self-extinguish, the ignition point may extend and develop to fire, so that the extinguishing agent $SF_6$ must be used to put the fire out. On the other hand, when the molten magnesium material to which alkaline earth metals as a flame resistant agent are added is cooled and solidified into an ingot, the resultant ingot is always provided with porosity (which means hereinafter that a number of concave like points of less than 2 mm appeared on a cross-section of the cast body). It is a big problem because the porosity is hard to remove.

Accordingly, a first object of the present invention is to provide a method for producing the refined magnesium material which is more improved in the flame resistant property and is easy to handle and safe, that is, a method for suppressing generation of the ignition points.

A second object of the present invention is to provide a refined magnesium material which has the flame resistant property due to such an alkaline earth metal added thereto and includes substantially no porosity, which is easy to be generated when the molten magnesium material is cooled and solidified, if the flame resistant agents such as alkaline earth metals are added to the molten magnesium materials.

There is currently proposed a method for refining the magnesium alloy in Japanese Patent Publication 291350/1991 (unexamined), wherein a similar way to that of a refining method for aluminum material is applied to the molten magnesium material, that is, the magnesium material in a molten state is subjected to a bubbling process to adhere the impurity to the bubbles, resulting in floatation of the impurity on the surface of the molten magnesium material. In order to keep the impurity floating on the surface of the molten magnesium material, which might be otherwise dragged into the molten magnesium material due to the bubbling, it is necessary to blow up the bubbles quietly and uniformly in a way not to disturb the surface of the molten magnesium material. Further, in order to suppress the circulation movement in the molten magnesium material, which causes the impurity dragging, the upward movement speed of the bubble is devised higher than the downward movement speed in the molten magnesium material. Additionally, suppression of the oxidation at the surface of the molten magnesium material is attempted. It is not difficult not to disturb the surface of the molten magnesium material, but it is difficult practically to speed up the upward movement speed of the bubble without circulation movement as well as to prevent the oxidation on the surface of the molten magnesium material. Consequently, it is troublesome and causes loss of the efficiency in the refining process to satisfy all these restrictions.

In addition, among methods wherein the impurity can be removed, there is provided a refining method of returned material or scrap (secondary refining process). This method is to use a melting flux (Dow Chemicals), such as #230 or refining flux #310 including, as a main ingredient, potassium chloride or magnesium chloride. The melting flux is used to prevent the molten magnesium from catching fire, which requires the whole of the surface of the molten magnesium material to be covered by the flux. As a result, a part of the melting flux remains in the molten magnesium material, resulting in degradation of the mechanical property and the resistance to the corrosion of the resultant ingot of magnesium alloy.

Anyway, the conventional refining method hardly suppresses occurrence of the ignition points and the generation of the porosity in the solidified ingot of the magnesium material.

DETAILED DESCRIPTION OF THE INVENTION

Figure 1:
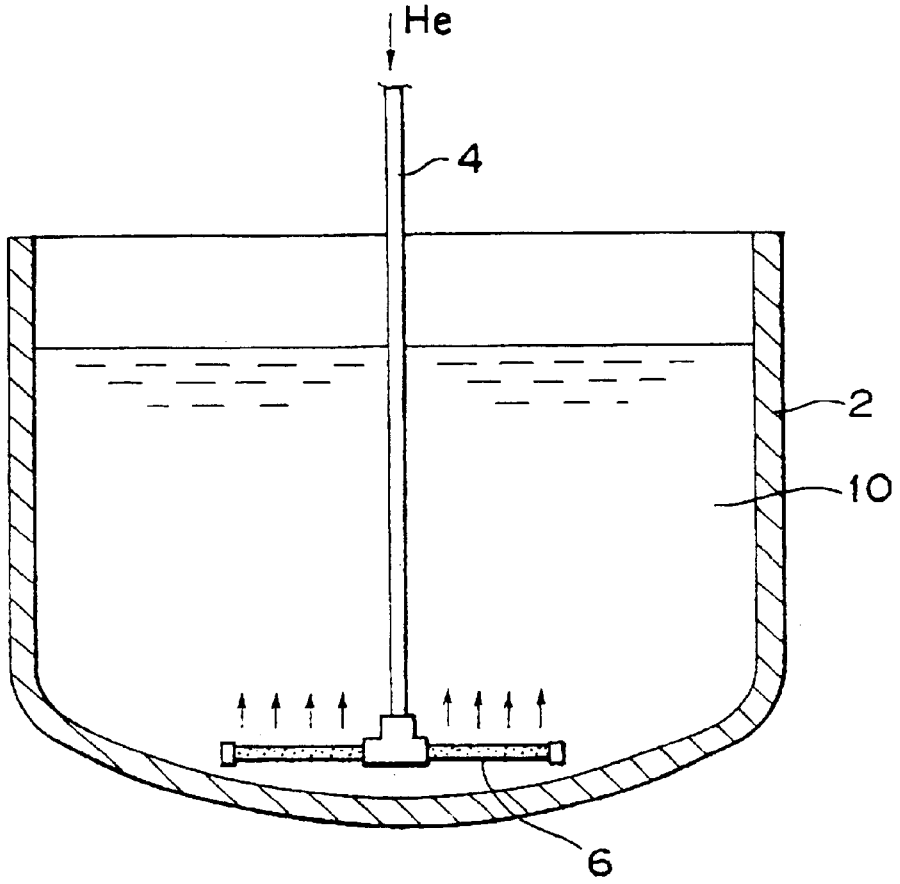
FIG. 1 is a cross sectional view of a melting crucible with a blowing pipe of rare gas.
Figure 2:
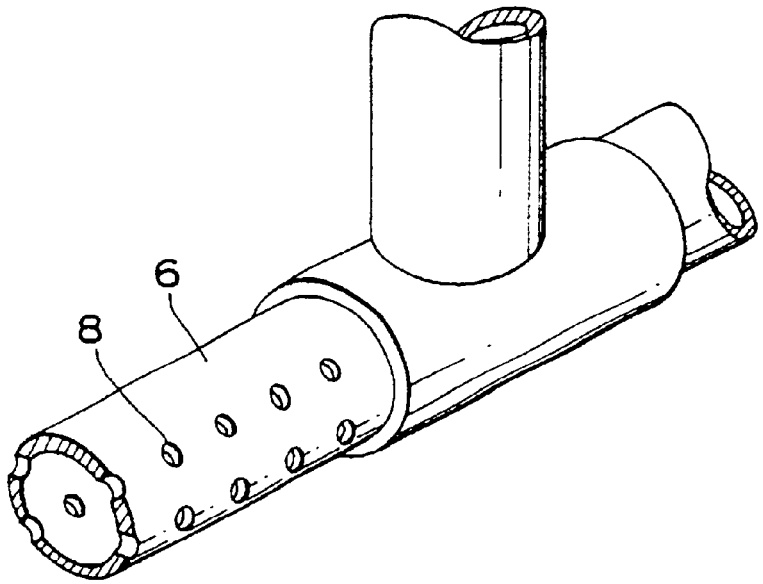
FIG. 2 is a perspective view of rare gas blowing pipe.

The present inventors have found the following new facts different from the disclosure of the Japanese Patent Publication 291350/1991 (unexamined). That is, 1) a vertical vortex flow given to the molten magnesium material covered with the dross exposes the molten magnesium material coming up from the bottom of the crucible successively to the air, resulting in formation of a thin film of dross on the upper surface of the molten magnesium material. The thin film of dross wraps the ignition source material (which hereinafter is referred to as the impurity) and then is aggregated to a corner of the crucible due to the vortex flow of the molten magnesium material. As a result, the impurity aggregated at the corner of the crucible tends not to re-diffuse. The continuous vortex flow of molten magnesium material makes it possible to repeat a step of exposing the surface of the molten magnesium material to the air, a step of forming a thin film of dross, a step of adhering the impurity to the dross, and a step of accumulating the dross at the corner of crucible to prevent the impurity from rediffusing. As a result, 2) it is possible to execute efficiently the refining and purifying process of the molten magnesium material. Further, 3) the ingot obtained by cooling and solidifying the molten magnesium material in accordance with the present invention has a much smaller number of porosities included therein.

Further, it is also found that the molten magnesium material to which alkaline earth metal is added shows a property of a high viscosity upon receiving no external force but comes to show a viscosity the same as that of the molten magnesium material having no alkaline earth metal upon receiving the external force. As a result, the molten magnesium material also comes to have a lower viscosity by aid of adding an external force, that is, applying the vertical vortex flow to the molten alloy, resulting in easy floatation of the impurity. Thus, a useful effect is given by the refining method according to the present invention.

On the basis of these findings, the present invention can be completed to provide a method for producing the refined magnesium material, which comprises a step of adding at least one alkaline earth metal selected from the group consisting of calcium, barium and strontium to a molten magnesium material to make the molten magnesium material flame resistant; a step of stirring the molten magnesium material so as to cause a vertical vortex flow; a step of contacting actively or positively the surface of the molten magnesium material with air or other gas capable of forming a dross to form the thin film of dross and a step of depositing the impurity floating on the surface of molten magnesium material to the thin film of dross formed on the surface of the molten magnesium material so that the impurity does not diffuse again.

In the flame-resistant molten magnesium material even if alkaline earth metal is added as a flame resistant agent thereto, sufficient flame resistant property is not given and a few ignition points can be found here and there during the casting process (for example, 1 to 3 ignition points per surface of 5,000 $cm^2$). The reason for occurrence of the ignition point is not understood. On the other hand, in the molten magnesium material refined in accordance with the present invention, the ignition point during the casting process can be suppressed substantially. The molten magnesium material can be treated safely and thus the simple automatic casting process can be done in a similar way to that of the aluminum alloy. Surprisingly, the ingot subjected to no refining process includes 20 porosities per 40 $cm^2$ as the porosity of pores of a diameter larger than 0.5 mm while the ingot subjected to the refining process according to the present invention shows substantially no porosity. In general, the pores larger than 0.5 mm in a diameter are found in an amount of less than 5 per 40 $cm^2$ at most. With regard to the porosity of pores less than 0.5 mm in a diameter, it is possible to supply the magnesium alloy ingot having the same porosity level as that of the commercially available alloy ingot. A study on the porosity of the commercial alloy AZ 91 indicates that the pores larger than 0.5 mm in a diameter are found in an amount of 10 per 40 $cm^2$ at most and the pores smaller than 0.5 mm in a diameter are found in an amount of 50 to 100 per 40 $cm^2$. The magnesium alloy according to the present invention shows 100 per 40 $cm^2$ at most with regard to the porosity smaller than 0.5 mm.

The porosity of pores larger than 0.5 mm has a worse influence on the mechanical property and sealing capability of the resultant product of magnesium alloy than that of the porosity smaller than 0.5 mm. With regard to the porosity larger than 0.5 mm, it is possible to obtain the magnesium alloy ingot having the same porosity content or rate as that of the commercial ingot by adjusting the optimum manufacturing condition as described later. The eye inspection can detect the presence of the porosity of pores larger than 0.5 mm as a spot on a cut plane or polished plane obtained with a wet cutting machine such as fine wet cutting machine, a wet belt or rotating disk type polisher. The porosity of pores smaller than 0.5 mm can be detected by a color check method for checking cracks used widely in the aluminum alloy casting product or other cast metal, in which the number of pores smaller than 0.5 mm can be counted.

In the present invention, an increase in the additive amount of alkaline earth metal results in a promoted flame resistance but a decrease in the corrosion resistance at the same time. Therefore, an addition of corrosion resistant metal may improve the corrosion resistance.

The magnesium material has alkaline earth metal such as calcium, barium or strontium added thereto. Among them, it is preferable to use calcium in view of the commercially availability. In the case of that the molten magnesium material requires a flame resistant property without strong requirement of the corrosion resistance, the operable content is from 0.1 to 5 weight % and preferably from 0.4 to 3 weight %. In the case of that the molten magnesium material requires the corrosion resistance together with the flame resistant property, it is necessary to add the corrosion resistant metal as well as the alkaline earth metal as a flame resistant agent. When the additive amount of corrosion resistant metal increases, an increase in the additive amount of the alkaline earth metal has little effect on the degradation of the corrosion resistance. In this case, it is preferable that the additive amount of alkaline earth metal is more than 0.1 weight % and less than 10 weight %. More preferably, it is less than 8 weight %. The most preferable range is from 0.5 to 5 weight %. It is not necessary to add more than 10 weight %. It is preferable that the additive amount of the alkaline earth metal is as low as possible in view of the requirement for the lower cost and the requirement that the characteristics of the original magnesium material are kept unchanged.

It is possible to use one metal as a corrosion resistant metal selected from the group consisting of Zn, Cd, Pb, Sn, Si, Mn and Zr. One or two kinds of metals are added to the magnesium material together with the alkaline earth metal. In view of a low cost and a safety handling, Zn is preferable. An additive amount of the corrosion resistant metal varies depending on the kind of additive metal and the content of the corrosion promoting metal in the magnesium material. The operable amount of corrosion resistant metal is less than 10 weight % and preferably less than 8 weight %. An excessive amount of additive metal resistant to the corrosion occasionally lowers the corrosion resistance.

Additionally, in order to prevent a large difference in the characteristic between the original magnesium material and the resultant magnesium material, the additive amount is preferably less than 10 weight %. The additive amount of the corrosion resistant metal is determined by the corrosion resistant test of salt spraying using a sodium chloride aqueous solution, if necessary.

The stirring method according to the present invention is to give a shearing force to the molten magnesium material to provide the molten magnesium material with a low viscosity capable of floating the impurity. Thereby, the dross is formed in sequence on the upper surface of the molten magnesium material which is partly opened to expose the molten magnesium material to air due to the vertical vortex flow. The molten magnesium material shows a property of a high viscosity when the molten magnesium material contains alkaline earth metal and has no external force applied thereto. On the other hand, the molten magnesium material shows a property of a low viscosity when an external force is applied to the molten magnesium material. Such a viscosity obtained is nearly equal to that of the alloy having no alkaline earth metal added thereto and is greatly smaller than the molten magnesium material in a static state.

The stirring method is classified into two methods: one is to blow a inert gas into the molten magnesium material and the other is to compel the molten magnesium material to circulate mechanically.

Either of the methods must give a vertical vortex flow to the molten magnesium material. If a horizontal vortex flow occurs, a flow changing plate disposed at a given angle may change it to the vertical vortex flow.

The inert gas used in the bubbling method is one selected from the group consisting of helium, neon, argon or xenon. The inert gas may be of the same purity as the industrial level. The inert gas can be used in a form of single gas or a mixed gas.

The inert gas may be blown thereinto in the following manner: 1) When magnesium material is melted, and additives are added to the molten magnesium material. 2) When an ingot of a flame resistant magnesium material is melted. 3) When the weight of the molten magnesium material increases by addition of an ingot, returned material scrap or waste powder of a cutting process. In general, the inert gas is compressed and blown through fine holes into a molten magnesium material. For example, FIG. 1 shows a rare gas blowing device which is of a T letter form. The horizontal bar has holes of 2 to 3 mm diameter opened at the surface thereof. The holes are spaced out 5 mm apart from each other and are formed into 3 or 5 rows in the longitudinal direction. Another example is to use a rotating disc which is used for removal of gas and oxides from the molten aluminum alloy (for example GBF made by Showa Aluminum CO. or Bubclean made by Kobe Seiko Co.) It is not necessary to adjust the gas pressure with a specified device. It is possible to use the inert gas at a pressure of 0.5 to 4 $kg/cm^2$ from a conventional gas container. The flowing rate of the inert gas is dependent on the amount of the molten magnesium material and may be determined by a presence of the ignition point of the molten magnesium material and number and size of porosities generated in the solidified magnesium alloy. In general, the operable gas flowing rate for getting a good result may be 10 to 30 liters/second per 100 to 300 liter of the molten magnesium material. When the gas flowing rate is lower than the above rate, it does not cause the molten magnesium material to form a vertical vortex flow sufficient to obtain the desired result. On the other hand, the flowing rate higher than the above rate causes the dangerous bumping in the molten magnesium material and increases the waste of the inert gas and molten magnesium material due to the excessive formation of the dross.

During a step of blowing the inert gas therein, there is a continuous burning of gas with orange color at a position above the surface of molten magnesium material. This does not induce the ignition of the molten magnesium material. The gas blowing time varies depending on the gas flowing rate and the crucible size but it takes preferably 2 to 40 minutes and more preferably 4 to 20 minutes. It is not necessary to blow the inert gas as long as the molten magnesium material is present. The inert gas blown for a given time period permits the molten magnesium material to be kept at a good condition even after stopping of the inert gas blowing. It is preferable that the blowing position is the bottom of the molten magnesium material and the movement [thereof] of the blowing position causes a good effect rather than non-movement thereof. The vortex flow can be generated mechanically in the following way: 1) In the case of using an electromagnetic pump supply of molten metal or a fan type pump supply of molten metal which have been used in the magnesium material casting, the molten metal pumped out is supplied to the molten magnesium material in a vertical direction to the surface of the molten magnesium material. 2) In the case of using a stirring machine for mainly forming a horizontal vortex flow, it is necessary to arrange the flow changing plate in a manner to direct the horizontal vortex flow upward to form a vertical vortex flow.

The mechanical stirring method can be operated in a similar way to that of the inert gas blowing method mentioned above in connection with the blowing timing and the same maintenance of the effect can be obtained. The inert gas blowing method is of a lower cost and easier operation than the mechanical stirring method.

It is preferable that ¾ area of the total surface of the molten magnesium material is exposed to air or other gas. This can be achieved by adjusting the blowing gas pressure and a supplying amount of molten magnesium material so that vertical convection is caused.

Anyhow, the most preferable operation and condition can be easily determined by the generation frequency of the ignition point and the number of porosities in the solidified magnesium alloy in association with the consideration on the shape and size of the crucible and the loadings of the alkaline earth metal.

The flame resistant molten magnesium material can be formed in the following way: calcium or calcium and corrosion resistant metals such as or zinc are added firstly to the molten magnesium material, which may be kept still for some time. After that, the molten magnesium material is stirred with a stirring bar to dissolve the additives uniformly in the molten magnesium material. The stirring time varies depending on the crucible size and the stirring ability but generally 5 to 60 minutes of stirring make the molten magnesium material to be a uniform composition. It is preferable to seal or overspread the molten magnesium material with the inert gas such as $SF_6$, $CO_2$, $N_2$, or Ar until the dissolution of additives in the molten magnesium material has completed. At the later period of the stirring operation, it is not necessary to seal or overspread the molten magnesium material with the inert gas. When the molten magnesium material is stirred in air at the later period, the molten magnesium material causes only a smaller number of ignition points which is not sufficient to the industrial application but hardly induces a serious fire.

The overspread atmosphere gas after formation of molten magnesium material can comprise any gas to form the dross upon being in contact with the molten magnesium material. It is possible to use $SF_6$ gas or $CO_2$ gas used during the melting process and also use air, that is, the molten magnesium material can be exposed to air. The overspread atmosphere gas is in contact with the molten magnesium material in a step of convection motion and makes a thin film of dross composed of sulfide, sulfate, fluoride, carbonate and oxide. The dross is moved to the corner of crucible and accumulated at the corner.

It is not preferable to select a high pressure of the overspread atmosphere gas by which the dross is formed in a thick layer after reaction with the molten magnesium material, because this results in a large amount of waste molten magnesium material. It is preferable to determine the suitable gas pressure and the suitable gas kind in a way that the dross is of a film as thin as possible, considering the ignition point number, the number of pores in the solidified magnesium material and the amount of the waste molten magnesium material.

The air is low in the cost and is suitable for formation of a thin film of dross. The molten magnesium material can preferably be exposed at an area of 1000 to 1500 $cm^2$ per 5000 $cm^2$ of the surface of the crucible.

It is preferable that the magnesium material includes an amount of corrosion promoting metal such as iron, nickel or copper that is as low as possible. Among the magnesium material Az 91 including 9 weight % of aluminum (hereinafter % means wt. %) and 1 % of zinc, a preferable alloy is AZ 91D or AZ 91E because of a low content of impurity. The other representative examples are AM 60 and the pure magnesium. It is possible to reinforce the magnesium material into a composite material by adding powders or short fibers of foreign materials. The preferable short fiber comprises inorganic fibers such as silica, alumina, alumina silica, SiC and carbon fiber or their whiskers. The fiber has an operable length less than 1 cm and preferably less than 0.5 cm. The operable shortest length is sub-micron. The fibers longer than 1 cm can be blended, but interlocked with each other in the molten magnesium material. The resultant molten magnesium material has a high viscosity and is of a poor fluidity, which prevents an incorporation of a large amount of reinforcing material. In order to obtain a composite material including a large amount of reinforcing fibers, a general method is to form a preform and to insert the reinforcing material into the preform through squeezing. The reinforcing material in a powder form comprises alumina, SiC, alumina silica, aluminum nitride, aluminum boride, tungsten carbide or spinel. The suitable particle size is 0.1 to 300 $\mu$cm. The powder less than 0.1 $\mu$m may partly float and makes the viscosity higher, resulting in a poor casting property. The powder larger than 3000 $\mu$m hardly forms a composite material having the powders uniformly dispersed therein. Among these reinforcing materials, some materials react with the magnesium material in a molten state. In such a case, it is preferable to add a several % of calcium to the molten magnesium material. It is to be noted that the maximum mixing ratio of the foreign material is 35 volume %. It is difficult to add the foreign material of more than 35 volume % to the molten magnesium material. Due to dipping in solvent such as alcohol of foreign material such as ceramics, the foreign material shows a higher apparent density and is improved in the wettability with the molten magnesium material and in the dispersion ability in the molten magnesium material. It is possible to evaluate the effects caused by the kind, the particle size and the additive amount of reinforcing material, and also the effects caused by the kind of wettability promoting agent through an eye inspection of the molten magnesium material. This makes it possible to pre-determine the preferable ranges.

Since the molten magnesium material is made to be flame resistant in accordance with the present invention to which alkaline earth metal is added, there is no danger even when stirring to cause the vertical vortex flow to generate ignition points. On the other hand, an addition of alkaline earth metal increases the static viscosity of the molten magnesium material. However, the vortex flow motion applies the shearing force to the molten magnesium material, resulting in a low viscosity of molten magnesium material which promotes the floating of impurity. Further, a thin film of dross formed on the upper surface of molten magnesium material through the reaction between the molten magnesium material and the overspread atmosphere gas causes the impurity to adhere thereto in a way to be enclosed thereby and is shifted to the corner of the crucible so that the impurity does not diffuse again. In such a way, the resulting molten magnesium material can suppress the number of ignition point and decrease the porosity number in solidified material. The control of the various conditions in a appropriate way results in an ingot compatible in the porosity number with the ingot commercially available. When the casting product is prepared by using an ingot having a large number of porosities, the final casting product shows the porosity number the same as that of the initial ingot, that is, the porosities disappear during the casting process. The casting method widely used is a die casting in which the final product is provided with many number of voids even when the ingot having no porosity is used. In order to obtain the reliable quality of the resultant product, it is important to use the ingot having no substantial porosity.

When the final ingot is provided with voids, a resultant thin casting product may have a problem such as inferior mechanical property, and the poor oil-, water- and air-tight problem of a sealed device. Accordingly, it is important and necessary to obtain the ingot having no substantial porosity.

Accordingly, comparing the present invention with the conventional refining method to raise the impurity adhered to the bubble through the bubbling, the following operations are listed for distinguishing between them: 1) The molten magnesium material is vigorously stirred in such a way that the impurity does not adhere to the bubble (to form vertical vortex flow). 2) The dross is formed into a thin film upon the contact of the molten magnesium material with the overspread atmosphere gas, to which film the impurity adheres, resulting in retention of the impurity without diffusing again.

3) The molten magnesium material processed with the shearing force applied thereto through the strong bubbling is provided with a lower viscosity capable of floating the impurity up to the surface of the molten magnesium material. 4) The floating impurity adheres to the dross film and is removed.

Additionally, while the conventional method is to only remove the impurity, the new method according to the present invention is to make the molten magnesium material flame resistant for suppressing the ignition points and to produce an ingot having no substantial porosity. These effects exceeding the conventional purification level can first be achieved by the refining method in accordance with the present invention.

According to the present invention, there is obtained the molten magnesium material, which is refined through the removal of the impurity, is superior in the flame resistant property to the molten magnesium material merely provided with alkaline earth metal. The ingot made from the molten magnesium material according to the present invention can be re-melted in air and the molten magnesium material can be processed in air in a similar way to that of molten aluminum material. It is possible to cast and operate the magnesium material automatically with the facilities for aluminum material. This makes the manufacturing cost of the magnesium material greatly lower.

In the molten magnesium material according to the present invention, removal of the impurity therefrom can decrease ignition points, resulting in improvement of the flame resistant property. Accordingly, as the additive amount of expensive alkaline earth metal becomes as small as possible, it is possible to decrease the additive amount of corrosion resistant metal such as zinc, too. As a result, the material cost is very low. In addition, the [porosity] number of pores is decreased to a level common to the commercially available alloy ingot, which prevents the degradation of the mechanical property of the resultant product due to the porosity. Furthermore, the present invention ensures to provide the magnesium material which properties are not changed by the additives.

EXAMPLE 1

FIG. 1 shows a melting crucible 2 provided with the molten magnesium 10 and a rare gas blowing pipe 4 equipped therein. The inert gas blowing pipe 4 is of a T letter shape having a horizontal bar 6 combined therewith. The horizontal bar 6 is arranged to be placed at near the bottom of the melting crucible 2. The inert gas is [usually] composed of helium. The horizontal bar 6 has the both ends closed and has holes 8 formed at the surface thereof. The holes have a diameter of 2 mm and are formed into four rows arranged in a longitudinal direction of 350 cm. The holes are apart from each other at an interval of 10 mm. The melting crucible 2 is combined with a lid which has an opening portion of 40×40 cm. The opening portion is covered with a door which is closed if necessary.

The following description will be directed to an example to form a molten magnesium and to cast by using the melting crucible 2 of FIG. 1. A starting material AZ91 alloy (Dow Chemicals Co.) of 400 kg is put in the melting crucible 2 and is heated at 650 to 750° C. into a molten state. 0.5% of calcium and 0.5% of zinc is dissolved in the magnesium material. Calcium has a specific gravity lower than AZ 91 alloy and then is put in an iron dipper covered with a stainless mesh. The iron dipper provided with calcium is inserted into the molten AZ 91 alloy and the dissolving process of calcium is checked by pulling the dipper up. It takes 8 minutes to dissolve calcium in the molten AZ 91 alloy. It is very easy to dissolve zinc into the molten AZ 91 alloy. During the melting process, the flowing gas of $SF_6/CO_2$ protects the surface of the molten alloy from contact with air in the crucible. The molten mixture is stirred with the iron dipper for 10 minutes so as to distribute uniformly calcium and zinc in the molten magnesium material and then has helium gas blown therein. The helium gas pressure is 1 $kg/cm^2$ and the blowing amount is 20 liter/min. for 10 minutes.

The molten alloy is covered at the whole surface with a dross before helium gas is blown. The bubbling helium gas pushes the dross to the corner of the crucible. As the bubbling helium gas is blown in a high pressure, the dross is wrinkled. Finally, the dross covers one fourth area of whole surface of the molten alloy. The residual ¾ area of whole surface comprises only a molten alloy which is waving. Even if the bubbling helium gas is stopped, the dross does not expand immediately and can be easily removed.

After that, the molten alloy is cast into an ingot of 5 kg under exposure to air by manually using the iron dipper. The total amount of obtained ingot is 395 kg.

The molten alloy exposed to the air makes oxides gradually formed at the surface thereof. At the initial period whereat the oxides are formed, there is not shown any ignition phenomenon. When the oxide is thicker, the molten magnesium material rises up thorough a gap of the oxide by means of a capillary action and sometimes ignites at the dross surface of the oxide. Therefore, the oxide layer is sometimes removed.

The reason may result from a small amount of alkaline earth metals acting as a flame resistor since the molten material which rises up through the gap of oxides includes a smaller amount of alkaline earth metals and acts as a pure alloy having no flame resistance. Accordingly, to avoid the ignition due to the capillary action, the molten magnesium material was ladled while the oxide layer is removed. Therefore, there is found substantially no ignition at the surface of the molten alloy, except only small ignition caused by some material adhered to the inner wall of the crucible or to the protection tube of a thermocouple.

The ingot of 5 kg has a largest sectional area of 40 $cm^2$ cut into 7 pieces vertically to a longitudinal direction by a wet high speed cutter. The cut plane is polished with an automatic wet polisher by using an abrasive paper #180 (Tri-M-ite) made by Wingo Co. The cut planes show the following number of pores larger than 0.5 mm:

| | | | |
|---|---|---|---|
| first cut plane | 0 | second cut plane | 1 |
| third cut plane | 3 | fourth cut plane | 0 |
| fifth cut plane | 1 | sixth cut plane | 0 |
| seventh cut plane | 0 | | |

The porosity (number of pores) is less than 1 per 40 $cm^2$ as a mean value. The cut plane obtained by a high speed cutting machine shows the porosity rate similar to that mentioned above.

The ingot thus prepared is stored for one month and is subjected to a die casting process in a cold chamber type. The casting is carried out by the following steps of sealing or overspreading the solid alloy with $SF_6/CO_2$ until the melting point and blowing the helium gas for 10 minutes and manually ladling the molten alloy exposed to air [for 10 minutes] to form a casting piece of a necessary amount. In a similar way to that mentioned above, a half amount of the molten ingot is cast under occasional removal of the oxide layer and the residual half is solidified in the crucible. In the next day, the residual alloy of a half amount in the crucible is melted again and has added thereto a cast product including fins and runners so that the final alloy is composed of 50% of returned material as scrap. The final alloy in a molten state has helium gas blown therein and is subjected to a die casting. The cast product including the fins and so on is of a weight of 0.75 kg.

During the die casting tests of two times, there is no ignition of magnesium thin film adhered to the dipper after the molten alloy is poured into an inlet of a die casting machine.

Two test pieces are made from each of three casting products. The test is carried out with 6 test pieces. The test results show that tensile strength is 19.9 kg/mm$^2$, the yield strength $\sigma_{0.2}$ is 14.2 kg/mm$^2$ and an extension rate is 3.3%. The test result is not related due to the content of the returned material. The corrosion resistance test indicates that the test piece remains 60% of metal phase after the spray test of the aqueous solution of sodium chloride for 240 hours.

For the comparison, the die cast product made from the original alloy of AZ 91 shows that the tensile strength is 21.6 kg/mm$^2$, the yield strength $\sigma_{0.2}$ is 13.0 kg/mm$^2$, and the extension rate is 3.9%.

Comparison 1

The comparison 1 is carried out by using magnesium material the same as that used in the Example 1 except for using the helium gas blown in the molten alloy. As a result, the molten alloy does not ignite during the preparation of the ingot and the die casting. However, there are some local ignitions at the surface of the molten alloy. It is necessary to introduce the gas $SF_6/CO_2$ for 10 minutes at every 30 or 60 minutes in order to extinguish the flame. However,the ignition is expanded slowly and does not cause the explosive fire. This comes from the magnesium alloy itself being made flame resistant due to the incorporation of calcium. The magnesium material in a thin film adhered to the dipper shows the ignition at one time per 30 to 45 shots but the ignition is self-extinguished and is naturally fading out.

The test on the AZ 91 of the corrosion resistance is carried out by a spray test of an aqueous solution of sodium chloride for 240 hours. It remains only 5% of the metal state.

In a similar way to that of embodiment 1, the porosity test is carried out. The porosity (number of pores per one cut area) is 15 to 23 and is 20 as a mean value.

It is clear from the comparison among Example 1, Comparison 1 and the result of AZ 91 that the flame resistant property is much improved by blowing helium gas in accordance with the present invention. It is understood that the obtained magnesium material has a characteristic similar to that of the original alloy and is greatly reduced in the porosity (number of pores), which is practically effective.

Comparison 2

The comparative example is carried out by using the same magnesium material as that of Example 1. The blowing amount of helium gas is made to an amount capable of covering the dross of the molten surface. The convection motion is suppressed as low as possible in such a way that the molten alloy is not observed. The ingot is prepared in a way that the other conditions are similar to those of Example 1. There is found no substantial wrapping and coagulation of the impurities by the dross thin film.

Comparison 3

Pure magnesium (Ube Kousan Co.) of 700 g is melted in a crucible having a lid. The following additives are added to the molten magnesium. The mixture is stirred for 3 minutes in air while using a lid for achievement of a oxygen deficient state. After being kept still for 5 minutes, the molten alloy is formed into an ingot having a sectional area of 18 cm$^2$ which is tested in the porosity generation.

(1) the contents of 1, 2, and 4% of Ca result in 5 to 10 pores;

(2) the contents of 3, 6 and 9% of Al generate no pores;

(3) the contents of 3 and 6% of Zn do not generate pores; and (4) pure magnesium does not generate pores.

As a result of the above, it is clear that the addition of Ca easily causes the generation of porosity.

EXAMPLE 2

The ingot is cast in similar way to that of Example 2 except for that the gas blowing time is prolonged from 10 minutes to 20 minutes. The section area shows no porosity of more than 0.5 mm or no substantial porosity of less than 0.5 mm.

EXAMPLE 3

This test is different from Example 2 in that the additive amount of calcium and zinc is increased by 1% and the inert gas to be blown into the molten alloy is argon in stead of helium. Comparison between a case of blowing the argon gas and a case of not blowing the argon gas in the flame resistant property shows a result similar to the relation between Example 2 and Comparison. It is noted that there is no ignition of the magnesium thin film adhered to the dipper during the die casting process. This comes from the fact that Example 3 has a calcium content higher than that of the Example 2.

The casting product according to Example 3 has a tensile strength of 21.8 kg/mm$^2$, an yield strength $\sigma$0.2 is 14.8 kg/mm$^2$ and an extension rate is 3.7%. The corrosion test by the sodium chloride aqueous solution for 240 hours indicates the same result as that of Example 2.

An ingot of 5 kg is cast in a similar way to that of Example 2 and tested with the porosity generation. The result is the same as that of Example 2.

It is understood that the cast product according to Example 3 is improved in the flame resistant property and is provided with a characteristic nearly similar to that of the original alloy. The cast product according to Example 3 has no special problem in connection with the number of porosities.

EXAMPLE 4

In order to make the characteristic of the magnesium alloy to be similar to that of the original alloy, the additive calcium is decreased to 0.4% and the corrosion resistant metal is not added. Helium gas as a rare gas is blown. The resultant alloy shows the flame resistant property similar to that of Example 2 but there is ignition at several points on the surface of the molten alloy. The magnesium alloy according to Example 4 can be cast in air. This is a different result from that of the magnesium alloy with no additive calcium. The magnesium alloy according to Example 4 has a mechanical property and a corrosion resistance similar to those of AZ 91 alloy.

EXAMPLE 5

Magnesium, AZ91 and AM60 each 2.5 to 3 kg are melted in a stainless crucible having an inner diameter of 15 cm. Alkaline earth metal and a corrosion resistant metal are added to these molten original metals. The additive weight % is shown in the Table below. In this case, the melting process and mixing process are carried out in air. However, magnesium is melted in a crucible having a lid to prevent the air from contacting with the molten magnesium. The molten alloy is stirred with a mechanical stirrer. After mixing, the dross on the surface of the molten alloy is removed. (When the dross is removed, the oxide film is immediately formed) Argon gas is blown into the crucible. It is confirmed that the molten alloy and the dross on the surface execute a convection movement. There is no ignition on the surface of the molten alloy. It is also confirmed that there is few porosities in the resultant alloy.

| No | Mg material | alkaline earth metal and additive amount, % | | corrosion resistant metal and additive amount, % | |
|---|---|---|---|---|---|
| 1 | Magnesium | Ca | 1.0 | | |
| 2 | | Sr | 1.0 | Zn | 0.7 |
| 3 | | Ca, 0.5 + Sr, 0.5 | | Zn | 0.7 |
| 4 | AZ 91 | Sr | 1.0 | Cd | 0.7 |
| 5 | | Ba | 3.0 | Zn | 2.5 |
| 6 | AM 60 | Ca | 1.0 | | |

EXAMPLE 6

In a similar way to that of Example 5, there is prepared AZ 91 alloy having 1% of calcium added thereto. The molten alloy is stirred with a mechanical stirrer. A stirring plate in a width of half of the inner diameter of crucible is provided around the inner periphery of the crucible. The stirring (or obstructive) plate and the inner wall of the crucible make an angle of 45°. As a result, the molten alloy shows a vortex flow in a vertical direction. The stirrer rotates at 100 rpm for 10 minutes. After this process, there is no ignition on the surface of the molten alloy. The cast ingot shows few porosities in a similar way to that of other Examples.

In order to observe the effect of the vortex motion, a beaker with a stirring plate is filled with water and is stirred with a magnetic stirrer. In order to watch the behavior of the impurity, monitoring pieces are made from wood pieces having a high wettability and pellets of 4 mm diameter of polypropylene having hardly any wettability and are inserted separately in the beaker.

The observation result is shown in the following Table. As long as the flow plate is provided, the impurity can rise up by stirring. This phenomenon shows no relation with and is independent to the wettability and the specific gravity of the impurity. It is understood that the molten magnesium material having a high reactivity generates a dross in a thin film due to the reaction with the overspread atmosphere gas, resulting in that the impurity is trapped by the dross and is removed.

| additives | no stirring | stirring | stirring with plate |
|---|---|---|---|
| wood pieces | float | float on central eddy, partly buried in the eddy but no diffusion | up down motion, but float adhered to the plate |
| polypropylene pellets | submerge | submerge at the bottom, circular motion around the center axis like a planetary motion but no up down motion | same as above |

What is claimed is:

1. A refined magnesium or magnesium alloy ingot or billet provided with no substantial porosity, which contains 0.1 to 10 weight % of at least one alkaline earth metal selected from the group consisting of calcium, barium and strontium and less than 10 weight % of at least one corrosion resistant metal selected from the group consisting of zinc, cadmium, lead, tin, silicon, manganese and zirconium.

2. A refined magnesium or magnesium alloy ingot or billet provided with no substantial porosity, containing 0.1 to 5 weight % of at least one alkaline earth metal selected from the group consisting of calcium, barium and strontium.

3. A refined magnesium alloy ingot or billet provided with no substantial porosity according to claim 1, which comprises 0.1 to 5 weight % of calcium and less than 8 weight % of zinc added to AZ 91 or AM 60 based magnesium alloy.

4. A refined magnesium alloy ingot or billet provided with no substantial porosity according to claim 2, which comprises 0.4 to 3 weight % of calcium added to AZ 91 or AM 60 based magnesium alloy.

5. A magnesium composite material which comprises the refined magnesium or magnesium alloy ingot or billet according to claim 1 and 0.1 to 35 volume % of at least one member selected from the group consisting of inorganic fibers or whiskers of less than 1 cm in length; or particle powder of 0.1 to 3000 $\mu$m in diameter.

6. The composite material of claim 5, wherein the length of the inorganic fibers or whiskers is 0.5 cm.

7. The composite material of claim 5, wherein the inorganic fibers or whiskers are formed from at least one material selected from the group consisting of silica, alumina, alumina silica, silicon carbide and carbon, and the particle powder is made from at least one material selected from the group consisting of alumina, alumina silica, silicon carbide, aluminum nitride, boron nitride, tungsten carbide and spinel.

* * * * *